United States Patent [19]

Cahall et al.

[11] Patent Number: 4,789,495

[45] Date of Patent: Dec. 6, 1988

[54] HYPOCHLORITE COMPOSITIONS CONTAINING A TERTIARY ALCOHOL

[75] Inventors: James L. Cahall, Cincinnati; Harold L. Dimond, Evendale, both of Ohio

[73] Assignee: The Drackett Company, Cincinnati, Ohio

[21] Appl. No.: 51,547

[22] Filed: May 18, 1987

[51] Int. Cl.[4] ..... C11D 7/54

[52] U.S. Cl. ..... 252/95; 252/102; 252/103; 252/547; 252/187.25

[58] Field of Search ..... 252/187.25, 187.26, 252/102, 103, 95, 547

[56] References Cited

U.S. PATENT DOCUMENTS

| | | | |
|---|---|---|---|
| 3,684,722 | 8/1972 | Hynam | 252/98 |
| 3,876,551 | 4/1975 | Laufer et al. | 252/98 |
| 3,929,661 | 12/1975 | Nakagawa et al. | 252/103 |
| 4,057,505 | 11/1977 | Nakagawa et al. | 252/96 |
| 4,229,313 | 10/1980 | Joy | 252/98 |
| 4,282,109 | 8/1981 | Citrone et al. | 252/102 |
| 4,287,080 | 9/1981 | Siklosi | 252/104 |
| 4,337,163 | 6/1982 | Schilp | 252/96 |
| 4,388,204 | 6/1983 | Dimond | 252/98 |
| 4,438,016 | 3/1984 | Kiewert | 252/174.25 |
| 4,461,652 | 7/1984 | Richmond | 134/2 |
| 4,552,680 | 11/1985 | Hartman | 252/102 |
| 4,585,570 | 4/1986 | Nelson | 252/102 |
| 4,588,514 | 5/1986 | Jones et al. | 252/98 |
| 4,599,186 | 7/1986 | Choy et al. | 252/102 |
| 4,623,476 | 11/1986 | Nayar et al. | 252/94 |

FOREIGN PATENT DOCUMENTS

| | | |
|---|---|---|
| 0093799 | 11/1982 | Japan . |
| 1466560 | 3/1977 | United Kingdom . |
| 2003522 | 3/1979 | United Kingdom . |

*Primary Examiner*—John F. Niebling
*Assistant Examiner*—Isabelle Rodriguez
*Attorney, Agent, or Firm*—Charles Zeller

[57] ABSTRACT

A phase stable alkali metal hypochlorite composition including a tertiary alcohol of from 4 to 8 carbons and a surfactant or surfactant blend. Said surfactant or surfactant blend preferably is selected to impart to the composition a viscosity of about 10 to about 150 cps.

11 Claims, No Drawings

HYPOCHLORITE COMPOSITIONS CONTAINING A TERTIARY ALCOHOL

FIELD OF INVENTION

The invention relates to alkali metal hypochlorite cleaning compositions. More specifically, the present invention relates to such bleach-containing compositions incorporating a tertiary alcohol to improve cleaning effectiveness. Most specifically, the compositions of the present invention contain, in addition to said tertiary alcohol, a thickening surfactant or surfactant blend to provide a composition viscosity of about 10 centipoise or greater.

BACKGROUND OF INVENTION

Sodium hypochlorite or bleach is a powerful disinfecting agent and is, therefore, preferred for use in general purpose cleaning compositions. Preparing sodium hypochlorite containing compositions for general purpose cleaning utilities, it is preferred to incorporate one or more surfactants to improve cleaning performance. It is also preferred to select the surfactant system such that it increases the viscosity of the resultant composition in order to improve application of the composition onto the surfaces being cleaned. This is especially true when the composition is employed as a cleaner for vertical tile walls and bathroom fixtures. It would also be beneficial to incorporate in the composition an organic cleaning vehicle or solvent to assist in the removal of certain types of soil deposits.

Hypochlorites are strong oxidizing agents and are, therefore, incompatible with many surfactants, as well as being generally incompatible with organic solvents. Incompatibility may be manifest by reaction of one or more actives with the hypochlorite, or by physical instability, especially where the bleach composition has been thickened. In the former case, the reaction reduces the level of the active constituents, and the composition is not effective to provide its cleaning function. In some instances unwanted reaction products may further decrease performance. Physical instability, that is, where the composition separates into two or more phases over time, detracts from ease of use by the consumer; may be difficult to reconstitute to form a homogeneous mixture, and could, if used, leave on the surface to be cleaned an undesirable film of active constituents that have been concentrated within one of the phases.

Applicants have found that certain tertiary alcohols may be included in effective concentration levels in alkali metal hypochlorite-containing compositions, to provide enhanced cleaning performance, which compositions are chemically and physically stable.

U.S. Pat. No. 4,623,476 to Nayar, et al., discloses stable suspensions of pigments in aqueous hypochlorite bleach compositions, the Nayar, et al., compositions comprising from about 3 to 10% sodium hypochlorite; from about 0.01 to 0.3% of selected dyes; from 0.025 to 0.2% of optical brightener 4,4'-bis(4-phenyl-2H-1,2,3-triazol-2-yl)-2,2'-stilbenedisulfonic acid or any one of its functional equivalent derivative salts; from about 0.05 to 2% of stated alkyaryl sulfonate surfactants; and at least 80% water.

Optionally, the Nayar, et al., compositions may include from about 0.1 to about 0.5% of a bleach stable organic oil disclosed at column 5, line 26 bridging to column 7, line 7, including $C_6$–$C_{20}$ tertiary alcohols of the formula $R_{11}R_{12}R_{13}COH$ wherein $R_{11}$ is a $C_3$–$C_{17}$ saturated akyl, and $R_{12}$ and $R_{13}$ are $C_1$–$C_{12}$ saturated acyclic alkyls.

The organic oil, when used in the Nayar, et al., composition, is admixed with the pigment, brightener, or surfactant solution prior to the addition of aqueous hypochlorite. The organic oil is included to increase the duration of pigment suspension in the composition, as well as to provide a fragrance thereto.

Thickened alkali metal hypochlorite compositions are known in the prior art. Thus, U.S. Pat. No. 4,388,204 to Dimond, et al., discloses thickened aqueous metal hypochlorite compositions wherein the thickening additive is composed of at least one of each of the following class of anionic surfactants: (a) alkali metal sulfate salts of ethoxylated aliphatic alcohols; (b) alkali metal salts of N-alkyl, N-acyl amino acids, and (c) alkali metal salts of alkyl sulfates. The Dimond, et al., compositions are intended primarily for use to unclog clogged drains, but may also be used as a general purpose cleaning composition.

U.S. Pat. No. 4,282,109 to Citrone, et al., discloses a thickened bleach composition including an aqueous solution of alkali metal hypochlorite and a thickening amount of a surfactant comprising (a) an amine oxide of the formula $R^1R^2R^2N{\rightarrow}O$ wherein $R^1$ is an optionally branched chain alkyl group containing 10 to 18 carbon atoms and $R^2$ is a lower alkyl group containing up to 3 carbon atoms, and (b) an alkali metal alkyl sulfate of the formula $R^3$—O—$SO_3M$ wherein $R^3$ is an optionally branched chain alkyl group containing 8 to 12 carbon atoms and M is lithium, sodium, or potassium, the ratio of the amine oxide to the alkali metal alkyl sulfate being not less than 3:4 and preferably greater than 13:8.

The thickened liquid bleach composition of Schilp, U.S. Pat. No. 4,337,163, incorporates as the thickening system a tertiary amine oxide and a fatty acid soap, and further contains an alkali metal orthophosphate buffer system to provide a pH of 10–12.5. U.S. Pat. No. 3,929,661 to Nakagawa, et al., discloses sodium hypochlorite compositions containing a surfactant of the formula $R_1R_2R_3CCH_2OX$, wherein $R_1$, $R_2$, and $R_3$, which can be the same or different, are alkyls of 1 to 18 carbons atoms, the sum of the carbon atoms being from 10 to 20; X is —$SO_3M$, —$CH_2COOM$, —$CH_2CH_2$-COOM, —$(CH_2CH_2O)_nSO_3M$ or —$(CH_2CH_2O)_n$-COOM, n being an integer of 1 to 40, and M is an alkali metal. In U.S. Pat. No. 4,057,505 to Nakagawa, et al., the surfactant is of the formula $R_1R_2CHCH_2OSO_3M$, wherein $R_1$ and $R_2$ are alkyls having 1 to 13 carbon atoms, the total number of carbon atoms being from 8 to 14, and M is lithium, sodium, or potassium. Choy, et al., U.S. Pat. No. 4,599,186, discloses thickened aqueous abrasive scouring cleaners wherein bleach-stable amine oxide surfactants may be incorporated. Other suitable surfactants includable in the Choy compositions are betaines, imidazolines, and certain quaternary phosphonium and tertiary sulfonium compounds. Similarly, U.S. Pat. No. 4,585,570 to Nelson discloses the incorporation of an amine oxide as a thickening component. See also U.S. Pat. Nos. 4,438,016 to Kiewert, et al., and 4,229,313 to Joy; GB No. 2,003,522A to Joy, and Japan No. 93,799.

Thickened bleach compositions are also disclosed in GB No. 1,466,560, the composition containing an alkali metal sarcosinate or tauride surfactant and another surfactant comprising (i) an alkali metal soap; (ii) a quaternary ammonium compound, (iii) an amine oxide, (iv) a betaine, or (v) an alkanolamide. See also U.S. Pat. Nos. 3,684,722 to Hynam, et al., and 4,588,514 to Jones, et al.

U.S. Pat. No. 4,461,652 to Richmond discloses a barnacle-removing process and product, the process comprising the steps of spraying the barnacled surface with a mixture comprising a hydrocarbon liquid oil; a surfactant; alcohol, a metal hypochlorite; and an alkyl, dialkyl benzel ammonium salt for about 20 minutes, the barnacles then being removed by power spraying with water. Any alcohol having a boiling point between 60° and 200° C. may be substituted for the preferred isopropyl alcohol.

Disadvantageously, primary and secondary alcohols are unstable in the compositions of the present invention, which require a suitable shelf life of at least about three months.

Accordingly, it is an object of the present invention to provide shelf stable aqueous hypochlorite compositions containing a tertiary alcohol and a surfactant or surfactant blend.

The primary objective of the present invention is to provide an alklai metal hypochlorite composition containing, to enhance cleaning performance, an organic solvent component which is a tertiary alcohol.

A further objective of the present invention is to provide a phase stable hypochlorite cleaning composition having a viscosity of at least about 10 centipoise, preferably from about 15 to about 75 centipoise.

These and other objects and advantages of the present invention are described in the detailed description of the invention, a summary of which follows.

SUMMARY OF THE INVENTION

Broadly, the compositions of the present invention comprise on a weight basis from about 0.5 to about 10% of an alkali metal hypochlorite, preferably sodium hypochlorite; from 0.1 to about 3% of a tertiary alcohol having from 4 to 8 carbons, preferably 5 to 7 carbons, especially 5 carbons; from about 0.5 to about 7% of a hypochlorite-compatible surfactant or surfactant blend, optionally up to about 10% of an alkali metal hydroxide, and water. Optionally, the compositions may include a functionally effective concentration of compatible perfumes and dyes.

In a preferred embodiment, the compositions of the present invention have a viscosity of above about 10 cps, preferably from about 15 to 150 cps, most preferably from 20 to 75 cps, which viscosity is achieved by inclusion of an effective thickening amount of a surfactant or surfactant blend provided as a thickening additive. The preferred thickening additive consists essentially of a blend of (i) from about 10 to about 50% of an alkali metal salt of an N-alkyl, N-fatty acyl amino acid; (ii) from about 30 to about 75% of an alkali metal salt of an alkyl sulfate, and (iii) from about 0 to about 65% of a $C_8$–$C_{18}$ alkyl $C_1$–$C_3$ dialkyl amine oxide.

DETAILED DESCRIPTION OF THE PREFERRED EMBODIMENT

The compositions of the present invention are aqueous alkali metal hypochlorite compositions preferably having a viscosity of about 10 centipoise or greater. The compositions are useful as general purpose cleaning compositions, especially in the cleaning of tile walls, porcelain fixtures, floors, and similar surfaces. However, the subject compositions may also be used as drain openers to unclog clogged drains or as a laundry additive. When the compositions of the present invention have a viscosity of above about 10 cps., preferably from about 20 to about 150 cps., most preferably from about 20 to about 75 cps., there is better control of the spray when the composition is applied from a spray container, typically, a manual spray container, but also including aerosol spray containers, which is highly preferred to reduce atomization of the hypochlorite ingredient. In addition, the thickened compositions exhibit better retention on vertical tile walls, and accordingly are more easily used by the consumer.

The preferred compositions comprise an alkali metal hypochlorite; a thickening amount of a surfactant or surfactant system suitable for obtaining the viscosity desired; a tertiary alcohol of from 4 to 8 carbons, preferably from 5 to 7 carbons, especially 5 carbons, and water. The compositions may further include an alkali metal hydroxide; a corrosion inhibitor; a heavy metal chelating or sequestering agent; and hypochlorite compatible dyes and fragrances. Where thickening is not a prerequisite of the subject composition, the thickening amount of surfactant is not necessary. Indeed, any hypochlorite stable surfactant may be used in place of the thickening surfactant or surfactant blend. In addition to the hypochlorite stable surfactants mentioned herein, mention may be made of aliphatic and aromatic ether carboyxlates, e.g., Sandolan RS-16 and PN-7 manufactured by Sandoz Colors and Chemicals, Inc.; alkyl benzene sulfonates, e.g., Dowfax 3B2 manufactured by Dow Chemical Company; aliphatic alcohol ethoxy sulfates, e.g., Neodol 25-3S manufactured by Shell Chemical Co.; and aliphatic ether sulfates, e.g., Calfoam ES-30 manufactured by Pilot Chemical Company. The surfactant or surfactant blend is generally present in the subject composition in an amount of from about 0.5 to about 7% of the total composition, preferably from about 1.5 to about 5% of the composition.

The hypochlorite may be a sodium, lithium, or potassium hypochlorite; however, sodium hypochlorite is preferred. The hypochlorite concentration is from about 0.5 to about 10% active NaOCl, which is typically commercially available as a 15% aqueous solution of the hypochlorite in water. Accordingly, the subject composition would typically contain from about 3.3 to about 66.7% by weight of said 15% hypochlorite solution. (Hereinafter, the hypochlorite constituent shall be reported on an active hypochlorite basis.) Preferably, the hypochlorite concentration is from about 2 to about 7% by weight, most preferably from about 2 to about 4% by weight of the composition.

An alkali metal hydroxide may also be present in the bleach compositions of the present invention in amounts up to about 10% by weight, preferably from about 0.5 to about 7% by weight, and especially preferably from about 0.5 to 4.0% by weight. The preferred hydroxides are potassium hydroxide and sodium hydroxide. Mixtures of the alkali metal hydroxides can be used. Typically, the pH of the compositions of the present invention is above about 10, preferably above about 11.

As made, hypochlorite solutions obtained commercially contain an equimolar concentration of the corresponding alkali metal chloride. With time the concentration of the alkali metal chloride increases according to:

$$MOCl \rightleftharpoons MCl + \tfrac{1}{2}O_2$$

The surfactant or surfactant blend used to thicken the hypochlorite composition may be any suitable thickener composition of the prior art, provided that the resulting composition has suitable shelf stability, generally at least about three months at ambient temperature. The viscosity of the hypochlorite bleach composition of the present invention is most preferably from about 20 to about 75 centipoise, especially where the composition is to be applied by means of a manual spray container. Higher viscosities, however, may be suitable for specialty cleaning products.

A preferred surfactant thickening blend comprises by weight of the thickening composition from about 10 to about 50%, preferably 15 to 25%, of an alkali metal salt of an N-alkyl, N-fatty acyl amino acid; from about 30 to about 75% preferably from 40 to 55%, of an alkali metal salt of an alkyl sulfate, and from about 0 to about 65%, preferably from 25 to 40%, of an amine oxide of the formula $R_1R_2R_2N \rightarrow O$, wherein $R_1$ is an alkyl of from about 8 to about 18 carbons and $R_2$ is an alkyl of from about 1 to about 3 carbons.

The N-alkyl, N-fatty acyl amino acid salt preferably is an alkali metal sarcosinate of the formula

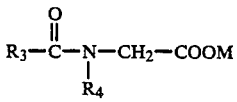

wherein $R_3$ is an alkyl of from 7 to 17 carbons, especially from 9 to 13 carbons; $R_4$ is an alkyl of from 1 to 4 carbons, and M is sodium, potassium, and lithium, preferably sodium. Especially suitable are sodium lauroyl sarcosinate, sodium myristoyl sarcosinate, and sodium stearoyl sarcosinate.

The alkali metal alkyl sulfate salt is generally of the formula $R_5SO_4M$, wherein $R_5$ is a linear or branched alkyl group of from 8 to 18 carbons, preferably from 10 to about 14 carbons, and M is sodium, lithium, or potassium, preferably sodium. Examples of the alkyl sulfate salt include the sodium, potassium, and lithium salts of decyl sulfate, dodecyl sulfate, lauryl sulfate, myristyl sulfate, and the like. These compounds may be used individually or as mixtures of two or more.

It is found that particularly good results are obtained with the commercial product Polystep B-25 manufactured by Stepan Chemical Company, which is a 38% aqueous mixture of a $C_{10}$ and $C_{12}$ alkyl sulfate in a 75:25 weight ratio.

With respect to the amine oxide, $R_1$ is preferably lauryl or stearyl, most especially lauryl, and $R_2$ is preferably methyl. A suitable commercially available amine oxide is Ammonyx LO, a 30% lauryl dimethyl amine oxide solution.

As indicated in U.S. Pat. No. 4,388,204 to Dimond, et al., it is important that the surfactant component be relatively free of impurities, salts, intermediates, and by-products that may deleteriously affect the stability properties of the final bleach composition. Accordingly, the amount of any such impurities should generally be less than about 3.0%, especially preferably less than about 1.5%, by weight of the surfactant on an anhydrous basis.

The tertiary alcohol is included to enhance cleaning performance of the hypochlorite composition. The tertiary alcohol is included in an amount from about 0.1 to about 3% by weight of the composition, preferably from about 0.50 to about 2.0%, most preferably from about 0.75 to 1.50%.

Suitable alcohols are those having eight or fewer carbon atoms in the alcohol molecule. Specific examples of the tertiary alcohol include 2-methyl-2-propanol (tert-butyl alcohol); 2-methyl-2-butanol (tert-amyl alcohol); 3-methyl-3-pentanol; 3-ethyl-3-pentanol; 2-methyl-2-hexanol, and 2-methyl-2-pentanol. Although 3-ethyl-3-pentanol provides directionally better performance than the aforementioned alcohols, tert-amyl and tert-butyl alcohols are preferred because of cost.

The compositions preferably include from about 0.3 to about 5%, more preferably from about 0.3 to abut 2%, of a suitable corrosion inhibitor. A preferred inhibitor is a sodium silicate such as Silicate-N manufactured by Philadelphia Quartz Chemicals.

The compositions of the present invention may be prepared simply by mixing the aforementioned ingredients with sufficient stirring. However, it is preferred to first prepare an aqueous solution of the alkali metal hypochlorite including sodium hydroxide and adjuvants, and to then add to the premix the surfactant ingredients and the tertiary alcohol. A particularly efficient method for mixing the thickening additive with the premixed aqueous solution of the alkali metal hypochlorite is to simultaneously pump the thickening additive and the premixed aqueous hypochlorite preparation through a static mixer. It has also been found that the alkyl sulfate tends to be difficult to disperse if added to the hypochlorite solution first. It is advantageous, therefore, to prepare a thickener premix which may be added to the hypochlorite solution in either a batch or continuous mixing process.

The invention is further illustrated by the following representative, nonlimiting examples of specific embodiments.

EXAMPLE 1

The compositions reported below were prepared and evaluated for their ability to clean test panels soiled with soap scum. Unless otherwise indicated all compositions reported in the examples is on an active ingredient basis.

| Constituents | Concentration, Wt. % |
|---|---|
| Sodium hypochlorite | 3.05 |
| Sodium lauroyl sarcosinate | 0.42 |
| Sodium decyl sulfate | 1.25 |
| Lauryl dimethyl amine oxide | 0.78 |
| Tertiary alcohol | As reported below |
| Sodium hydroxide | 0.61 |
| Sodium silicate | 0.56 |
| Deionized water | Q.S. |
| | 100.0% |

In the above base composition, t-amyl alcohol (2-methyl-2-butanol) was included at concentrations from 0% to 3% as indicated below. Each of the compositions containing an amount of the t-amyl alcohol was compared against the composition containing 0% t-amyl alcohol. These paired comparisons were conducted as follows: For each paired comparison three tiles were prepared by applying uniformly a coating of soap scum, each panel being divided into two sections. One section of each replicate was cleaned with 1 ml of the composition containing 0% t-amyl alcohol and the other section cleaned with 1 ml of the t-amyl alcohol-containing composition, the compositions being permitted to contact the sections for 1 minute and both sections being wiped with a damp sponge for 5 cycles on a Gardner Washability and Abrasion Machine. Each plate was rated blindly by 24 judges, who were requested to select the "cleaner section." The results are provided below, along with the viscosity values for each composition.

| Comp. No. | t-amyl alcohol (Wt. %) | Test Pair | Cleaner Side Judgments Comp. 1 | Cleaner Side Judgments Paired Comp. | Viscosity (cps.) |
|---|---|---|---|---|---|
| 1 | 0 | — | — | — | 144 |
| 2 | 0.25 | 1-2 | 16 | 56 | 75 |
| 3 | 0.5 | 1-3 | 20 | 52 | 55 |
| 4 | 1.0 | 1-4 | 12 | 60 | 24 |
| 5 | 1.5 | 1-5 | 19 | 53 | 16 |
| 6 | 2.0 | 1-6 | 13 | 59 | 10 |
| 7 | 2.5 | 1-7 | 10 | 62 | 8 |
| 8 | 3.0 | 1-8 | 4 | 68 | 8 |

For each paired comparison, the number of "cleaner side" judgments for the paired composition represents at least a 95% confidence level, as compared to the composition control.

EXAMPLE 2

A composition was prepared (Composition 9) which contained the same concentrations of the constituents as Composition 4 above, except that it contained 0% of the amine oxide and 93.11% water. Paired comparisons were conducted in the same manner as described in Example 1 with the following results:

| Paired Comparison | Cleaner Side Judgments Comp. 1 or 4 | Cleaner Side Judgments Comp. 9 |
|---|---|---|
| 1-9 | 3 | 69 |
| 4-9 | 13 | 59 |

EXAMPLE 3

The following Compositions 10–21 were prepared and observed for physical stability:

| Constituent | Concentration, Wt. % (Active Basis) 10 | 11 | 12 | 13 | 14 | 15 | 16 | 17 | 18 | 19 | 20 | 21 |
|---|---|---|---|---|---|---|---|---|---|---|---|---|
| Sodium hypochlorite | 3.0 | 3.0 | 3.0 | 3.0 | 3.0 | 3.0 | 3.0 | 3.0 | 3.0 | 3.0 | 3.0 | 3.0 |
| Sodium lauroyl sarcosinate | 0.42 | 0.57 | — | — | — | — | — | — | — | — | — | — |
| Sodium decyl sulfate | 1.25 | 1.70 | 1.25 | 1.70 | 1.51 | 2.07 | 1.51 | 2.07 | 0.90 | 1.33 | 0.90 | 1.33 |
| Lauryl dimethyl amine oxide | 0.78 | 0.92 | 0.78 | 0.92 | 0.94 | 1.12 | 0.94 | 1.12 | 1.0 | 1.47 | 1.0 | 1.47 |
| Sodium hydroxide | 0.61 | 0.61 | 0.61 | 0.61 | 0.61 | 0.61 | 0.61 | 0.61 | 0.61 | 0.61 | 0.61 | 0.61 |
| Sodium Silicate | 0.56 | 0.56 | 0.56 | 0.56 | 0.56 | 0.56 | 0.56 | 0.56 | 0.56 | 0.56 | 0.56 | 0.56 |
| t-Amyl alcohol | 1.0 | 1.0 | 1.0 | 1.0 | 1.0 | 1.0 | — | — | 1.0 | 1.0 | — | — |
| Deionized Water | (By difference) | | | | | | | | | | | |
| | 100.0 | 100.0 | 100.0 | 100.0 | 100.0 | 100.0 | 100.0 | 100.0 | 100.0 | 100.0 | 100.0 | 100.0 |
| Ratio, Amine oxide:Sodium decyl sulfate | 0.624:1 | 0.541:1 | 0.624:1 | 0.541:1 | 0.622:1 | 0.541:1 | 0.622:1 | 0.541:1 | 1.11:1 | 1.10:1 | 1.11:1 | 1.10:1 |
| Viscosity, cps. | 27.5 | 34.0 | | | | | | | 16.5 | 33.2 | 20.5 | 29.2 |

Compositions 10 and 11 were stable and did not separate into two phases. Each of Compositions 12–21 "broke" into two phases and required reconstitution by shaking before using. It is seen that sodium lauroyl sarcosinate was important in achieving phase stability in the amine oxide to alkyl sulfate ratio range tested. It is also seen that the alcohol constituent did not render the Compositions 10 and 11 unstable, and that its absence from the Compositions 16, 17, 20 and 21 did not provide physical stability.

EXAMPLE 4

The following Compositions 22–25 reported below were prepared:

| Constituent | Concentration, Wt. % |
|---|---|
| Sodium hypochlorite | 2.98 |
| Sodium lauroyl sarcosinate | 0.90 |
| Sodium decyl sulfate | 0.90 |
| Lauryl dimethyl amine oxide | 1.0 |
| Sodium hydroxide | 0.61 |
| Sodium silicate | 0.56 |
| tertiary alcohol | 1.0 |
| Deionized Water | Q.S. |
| | 100.0% |

In the above base composition, various tertiary alcohols were included at the 1.0% level. Paired comparisons with Composition 4 (containing 1% t-amyl alcohol and the surfactant mixture reported in Example 1) were made in accordance with the procedure of Example 1. The results are reported below.

| Comp. No. | t-Alcohol | Test Pair | Cleaner Side Judgements Comp. 4 | Cleaner Side Judgements Paired Comp. |
|---|---|---|---|---|
| 22 | 3-methyl-3-pentanol | 4-22 | 19 | 53 |
| 23 | 3-ethyl-3-pentanol | 4-23 | 2 | 70 |
| 24 | 2-methyl-2-hexanol | 4-24 | 19 | 53 |
| 25 | 2-methyl-2-pentanol | 4-25 | 12 | 60 |

Because each of the Compositions 22–25 was compared against the same "control," it is believed a comparison among the Compositions 22–25 is permissible. 3-ethyl-3-pentanol appeared to perform better than 2-methyl-2-pentanol, both of which faired better than 3-methyl-3-pentanol and 2-methyl-2-hexanol. No conclusion can be reached regarding the performance shown by these compostions as a function of carbon number.

EXAMPLE 5

A composition (Composition 26) was prepared which was essentially identical to Composition 4, but containing 1% t-butanol (2-methyl-2-propanol). Composition 26 had a viscosity of 55 cps. A paired comparison in accordance with the procedure of Example 1 resulted in 57 "cleaner side" judgements for Composition 4 and 15 "cleaner side" judgements for Composition 26.

EXAMPLE 6

Compositions 27 and 28 were prepared, which were essentially the same as Composition 3, except that 2,6-dimethyl-2-heptanol was substituted for t-amyl alcohol in Composition 27 and 3,7-dimethyl-3-octanol incorporated in lieu of the t-amyl alcohol in Composition 28. Composition 27 and 28 had viscosities of 7.5 and 9.0, respectively, and both "broke" into two phases. Abbreviated paired evaluations with Composition 3 provided the following results:

| | Cleaner Side Judgement | |
|---|---|---|
| Test Pair | Comp. 3 | Paired Comp. |
| 3-27 | 10 | 4 |
| 3-28 | 2 | 12 |

In view of the above results, neither higher carbon alcohol included in Compositions 27 and 28 is considered particular by preferred, in view of stability problems and low viscosity.

EXAMPLE 7

Primary, secondary and tertiary alcohols were tested for stability as measured by hypochlorite ion loss per day, as reported below. The test compositions contained 3.0% sodium hypochlorite (active basis), 1% of the alcohol and water.

| Alcohol | % Loss Per Day | Monitored Days |
|---|---|---|
| Methanol | 1.4 | 15 |
| Ethanol | 6.24 | 15 |
| Propanol | 6.24 | 15 |
| Butanol | 11.11 | 9 |
| Isopropanol | 5.65 | 15 |
| Isobutanol | 6.44 | 15 |
| Cyclohexanol | 5.65 | 19 |
| 2-Methyl-2-propanol | 0.06 | 90 |
| 2-Methyl-2-butanol | 0.04 | 93 |
| 3-Methyl-3-pentanol | 0.05 | 103 |
| 2-Ethyl-3-pentanol | 0.07 | 103 |
| 2-Methyl-2-hexanol | 0.07 | 103 |

The above detailed description is intended as being illustrative only of specific embodiments and not as limiting the scope of the invention as described in the appended claims.

We claim:

1. A phase stable aqueous cleaning composition comprising on a weight basis from about 1 to about 10% alkali metal hypochlorite; a thickening amount of a surfactant blend effective to provide a composition viscosity of from about 10 to about 150 cps; from about 0.1 to about 3.0% 2-methyl-2-propanol, and water.

2. The composition of claim 1 wherein the surfactant blend consists essentially of by weight of said blend (i) from about 10 to about 50% of an alkali metal salt of an N-alkyl, N-fatty acyl amino acid; (ii) from about 30 to about 75% of an alkali metal salt of a $C_8$ to $C_{18}$ alkyl sulfate, and (iii) from about 0 to about 65% of an amine oxide of the formula $R_1R_2R_2N \rightarrow O$, wherein $R_1$ is an alkyl group of from 8 to 18 carbons and $R_2$ is a lower alkyl group of up to 3 carbons.

3. The composition of claim 2 wherein the surfactant component (i) is selected from the group consisting of sodium lauroyl sarcosinate, sodium myristoyl sarcosinate, and sodium stearoyl sarcosinate; wherein the surfactant component (ii) is a sodium alkyl sulfate having from about 10 to about 18 carbons; and wherein the surfactant component (iii) is an alkyl dimethyl amine oxide, the alkyl having from about 10 to about 18 carbons.

4. The composition of claim 3 wherein the surfactant blend is present in an amount of from about 0.5 to about 7%.

5. The composition of claim 4 wherein the surfactant component (ii) is a mixture of sodium decyl sulfate and sodium dodecyl sulfate, and wherein the amine oxide is lauryl dimethyl amine oxide.

6. The composition of claim 4 wherein the surfactant blend consists essentially of from about 15 to about 25% component (i); from about 40 to about 55% component (ii), and from about 25 to about 65% component (iii).

7. The composition of claim 6 wherein the composition viscosity is from about 20 to about 75 cps.

8. The composition of claim 1, 2, 4, 6, or 7 wherein the 2-methyl-2-propanol component is present in an amount of from about 0.50 to about 2.0%.

9. The composition of claim 1, 2, 4, 6, or 7 wherein the 2-methyl-2-propanol component is present in an amount of from about 1.0 to about 1.50%.

10. The composition of claim 1 wherein from about 0.5 to about 10% alkali metal hydroxide is present in the composition.

11. The composition of claim 1 wherein the alkali metal hypochlorite is sodium hypochlorite and is present in an amount of from about 1 to about 6%.

* * * * *